US005447454A

United States Patent [19]

Inaba et al.

[11] Patent Number: 5,447,454

[45] Date of Patent: Sep. 5, 1995

[54] CONNECTOR

[75] Inventors: Shigemitsu Inaba; Shigemi Hashizawa; Hidehiko Kuboshima, all of Shizuoka, Japan

[73] Assignee: Yazaki Corporation, Tokyo, Japan

[21] Appl. No.: 228,552

[22] Filed: Apr. 15, 1994

[30] Foreign Application Priority Data

Apr. 16, 1993 [JP] Japan ..... 5-112407

[51] Int. Cl.[6] ..... H01R 9/22

[52] U.S. Cl. ..... 439/709; 439/299; 439/489; 439/924.1

[58] Field of Search ..... 439/296, 299, 345, 350, 439/488, 489, 677, 680, 709, 712, 713, 924

[56] References Cited

U.S. PATENT DOCUMENTS 4,607,903 8/1986 Hoshino et al. ..... 439/709 X
4,785,378 11/1988 Hinckley et al. ..... 439/709 X
5,017,147 5/1991 Sugiyama et al. ..... 439/299 X

FOREIGN PATENT DOCUMENTS 1274368 11/1989 Japan .

*Primary Examiner*—Khiem Nguyen
*Attorney, Agent, or Firm*—Sughrue, Mion, Zinn, Macpeak & Seas

[57] ABSTRACT

A plurality of terminals to be connected to opponent cables and a plurality of connector portion receiving cavities are stepwise arranged on a connector portion on the upstream apparatus side fixedly secured to a predetermined apparatus in parallel with a stationary plane of the connector portion on the upstream apparatus side. To electrically connect the connector portions on the upstream apparatus side to the connector portions on the downstream apparatus side, the connector portions on the downstream apparatus side are successively fitted into the connector portion receiving cavities in the direction at a right angle relative to extension of the terminals starting with the connector portion receiving cavity at the lowest stage. Whether or not the connector portions on the downstream apparatus side are correctly fitted into the connector portion receiving cavities at the lower stages is detected based on the fact that the connector portion on the downstream apparatus side at the upper stage is correctly fitted into the corresponding connector portion receiving cavity.

2 Claims, 8 Drawing Sheets

CONNECTOR

BACKGROUND OF THE INVENTION

1. Field of the Invention

The present invention relates generally to a connector for electrically connecting cable conductors such as wire harnesses or the like to various kinds of electronic devices, apparatuses or the like. More particularly, the present invention relates to a connector of the foregoing type including detecting means for detecting whether or not electrical connection is correctly established therebetween.

2. Description of the Related Art

Many connectors as shown in FIG. 13 and FIG. 14 have been used for electronic devices, apparatuses or the like. Specifically, a connector 1 is substantially composed of a connector portion 2 on the upstream apparatus side (hereinafter referred to simply as an upstream connector portion 2) to be fixedly secured to the chassis of an electronic apparatus (not shown) and three connector portions 3 on the downstream apparatus side (hereinafter referred to simply as downstream connector portions 3) each adapted to be attached to the connector portions 2. Male terminals (not shown) are arranged in a housing 4 of the upstream connector portion 2 orienting in the A direction at a right angle relative to the attachment surface of the upstream connector portion 2. When the downstream connector portions 3 are electrically connected to the upstream connector portion 2, they are attached to upstream connector portion 2 in the B direction, causing the male terminals to be electrically connected to three cables 5 by way of the assembled structure composed of the upstream connector portion 2 and the downstream connector portions 3.

Since the connector 1 of the foregoing type is simple in structure and can be fabricated at an inexpensive cost, it is widely used for various kinds of electronic devices, apparatuses or the like.

With the conventional connector 1 constructed in the above-described manner, a wide space is required for connecting the connector 1 to a certain apparatus in order to assure that the downstream connector portions 3 are easily and smoothly connected to and disconnected from the upstream connector portion 2. In cases involving a high intensity electric current, e.g., a driving system for an electric car, a diameter of each cable 5 is unavoidably enlarged, resulting in a large magnitude of a pushing/pulling force being required at the time of cable connection and disconnection. In this case, an especially large space is required for connecting the connector 1 to a certain apparatus. In view of the fact that space available for practically installing devices or apparatuses not only in various systems but also in an electric car is restrictively limited, the space allocated merely for cable connection and disconnection prevents the density of installing devices or instruments from being satisfactorily improved.

In addition, when it is found that some of the downstream connector portions 3 are erroneously attached to the upstream connector portion 2, or the attachment of some of the connector portions 3 to the upstream connector portion 2 is carelessly forgotten, it is required that all the downstream connector portions 3 are inspected again. This inspecting operation is troublesome and takes a long time.

Incidentally, an electric connector including detecting means is disclosed in an official gazette of Japanese Patent Laid-Open Publication No. 1-274368. The disclosed electric connector is equipped with a connector member serving as detecting means independently of a connector member serving as controlling means. However, the disclosed electric connector suffers from the following problems: it is complicated in structure; there are a great number of components constituting the electric connector; and the number of man-hours required for fabricating the electric connector is also great.

SUMMARY OF THE INVENTION

The present invention has been made in consideration of the aforementioned background.

An object of the present invention is to provide a connector which assures that connection is reliably established between a connector portion on the upstream apparatus side and a plurality of connector portions on the downstream apparatus side.

The present invention provides a connector comprising a connector portion on the upstream apparatus side fixedly secured to a predetermined apparatus; a plurality of connector portions on the downstream apparatus side electrically connectable to the connector portion on the upstream apparatus side; a plurality of terminals connectable to opponent cables stepwise arranged on the connector portion on the upstream apparatus side and located in parallel with a stationary plane of the connector portion on the upstream apparatus side; a plurality of connector portion receiving cavities stepwise arranged corresponding to the terminals; and detecting means for detecting whether the downstream connector portions are correctly respectively fitted into the connector portion receiving cavities, wherein the connector portions on the downstream apparatus side are successively fittable into the connector portion receiving cavities in the direction at a right angle relative to extension of the terminals, starting from the connector portion receiving cavity at the lowest stage, and wherein said detecting means detects whether the connector portions on the downstream apparatus side are correctly fitted into the connector portion receiving cavities at the lower stage based on the fact that the connector portion on the downstream apparatus side at the upper stage is correctly fitted into the corresponding connector portion receiving cavity.

To assure that a connector portion on the downstream apparatus side is reliably and correctly fitted into the corresponding connector portion receiving cavity, a pair of resilient protuberances adapted to be resiliently projected outside of the opposite side surfaces of a housing of each connector portion on the downstream apparatus side and received in the housing are provided. In addition, a pair of engagement grooves are formed on the opposite side walls of each connector portion receiving cavity at the positions where the resilient protuberances are received in the engagement grooves when the connector portion on the downstream apparatus side is correctly fitted into the connector portion receiving cavity.

With the connector constructed in the abovedescribed manner, since the terminals and the connector portion receiving chambers are stepwise arranged in parallel with the stationary plane of the connector portion on the upstream apparatus side, the connector portions on the downstream apparatus side can successively be fitted into the connector portion receiving cavities along the stationary plane of the connector portion on the upstream apparatus side in the direction at a right angle relative to extension of the terminals. In addition, since the connector portion receiving cavities are stepwise arranged and the connector portions on the downstream apparatus side are successively fitted into the connector portion receiving cavities, starting from the connector portion receiving cavity at the lowest stage, if the connector portion on the downstream apparatus side at the lower stage is incorrectly received in the corresponding connector portion receiving cavity, it is impossible that the connector portion on the downstream apparatus side at the upper stage is correctly fitted into the connector portion receiving cavity. This makes it possible for an operator to detect the present connected state on the connector portions on the lower apparatus side. In addition, the provision of the resilient protuberances on each connector portion on the downstream apparatus side and the formation of the engagement grooves adapted to receive the resilient protuberances assure that each connector portion on the downstream apparatus side is reliably and correctly fitted in the corresponding connector portion receiving cavity while preventing the connector portion on the downstream apparatus side from being disconnected from the connector portion receiving cavity.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail with reference to the accompanying drawings which illustrate a few preferred embodiments thereof.

First, a connector constructed according to an embodiment of the present invention will be described below with reference to FIG. 1 to FIG. 11.

Figure 1:
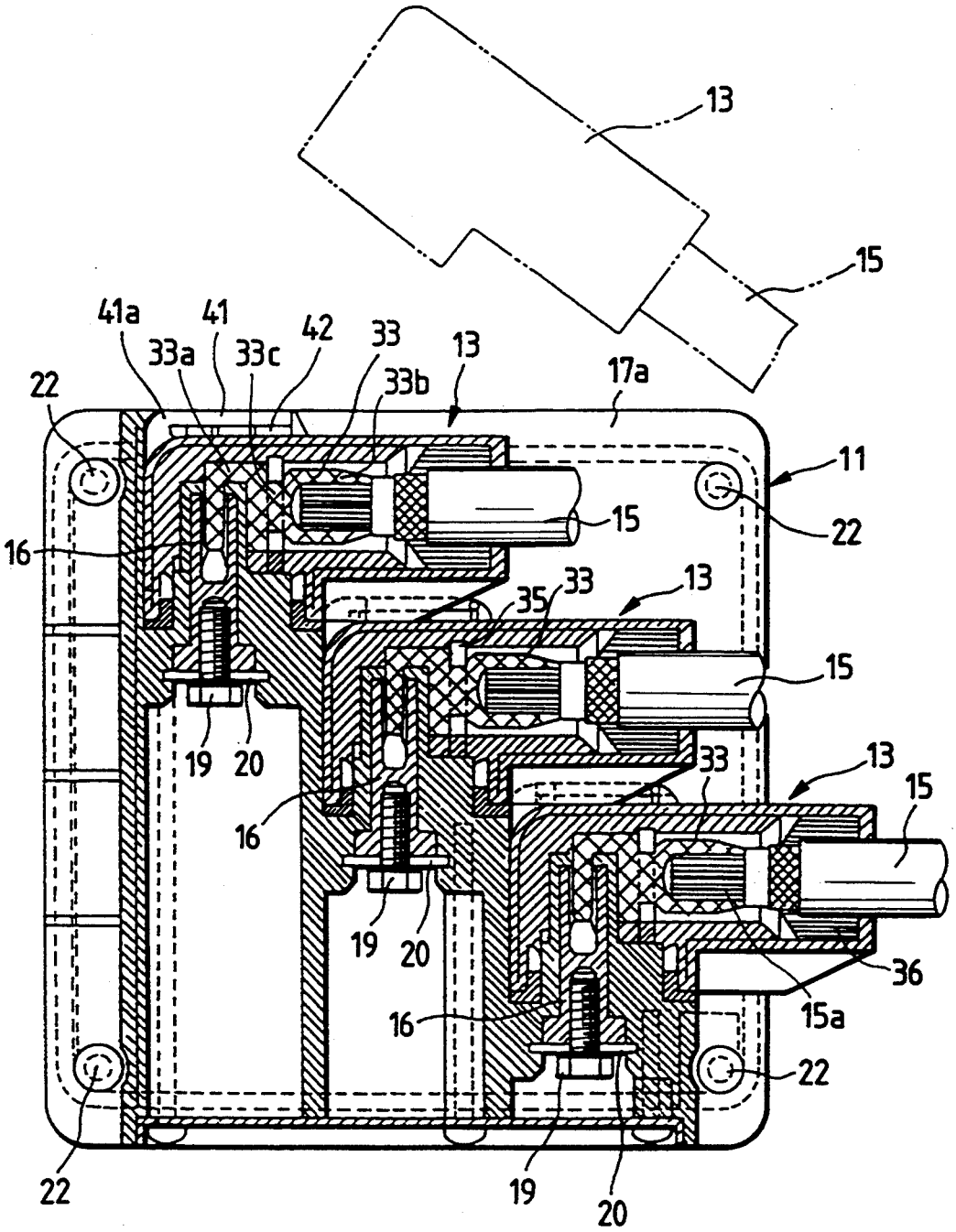
FIG. 1 is a sectional view of a connector constructed according to an embodiment of the present invention.
Figure 2:
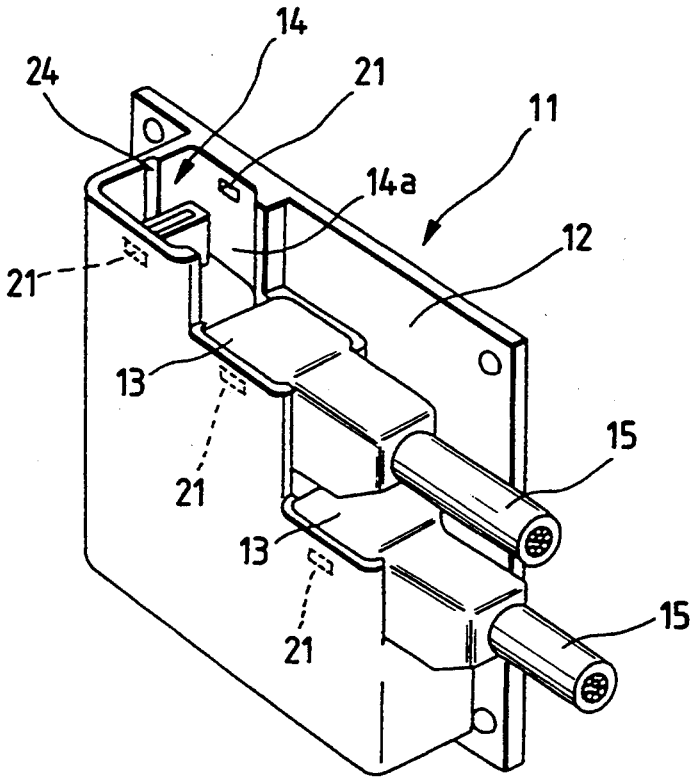
FIG. 2 is a perspective view of the connector shown in FIG. 1.

FIG. 1 is a sectional view of the connector, particularly showing the inner structure of the connector and the connected state among components included in the connector, FIG. 2 is a perspective view of the connector, FIG. 3 to FIG. 6 are illustrative views each of which shows the structure of a connector portion on the upstream apparatus side, and FIG. 7 to FIG. 11 are illustrative views each of which shows the structure of each connector portion on the downstream apparatus side. To facilitate understanding of the present invention, the connected state and the structure of each connector portion on the upstream and the structure of each connector portion on the upstream apparatus side will be described with reference to FIGS. 1–6, and the connected state and the structure of each connector portion on the downstream apparatus side will be described with reference to FIGS. 1 and 7–11.

As is best seen in FIG. 2, a connector 11 includes a connector portion 12 on the upstream apparatus side (hereinafter referred to simply as a upstream connector portion 12 or a connector portion 12) and three connector portions 13 on the downstream apparatus side) hereinafter referred to simply as downstream connection portions 13 or connection portions 13), and three connector portion receiving cavities 14 are stepwise formed on the upstream connector portion 12 with a stepped part formed between adjacent connector portion receiving cavities 14. A cable 15 is connected to each downstream connector portion 13. As shown in FIG. 1 and FIG. 2, when the downstream connector portions 13 are successively inserted into the corresponding connector portion receiving cavities 14, the downstream connector portions 13 can be electrically connected to the upstream connector portion 12 so as to enable electricity to be fed from the upstream apparatus side to the downstream apparatus side (or vice versa).

It should be noted that connection of each connector portion 13 to the connector portion 12 is achieved not by fitting by connector portion 13 into the connector portion receiving cavity 14 in the direction at a right angle relative to the plane connector portion 12 but by fitting the former into the latter from above while slidably displacing the former parallel to the plane of the connector portion 12. Accordingly, the need for keeping a wide space as mentioned above with respect to the conventional connector, is eliminated.

Figure 3:
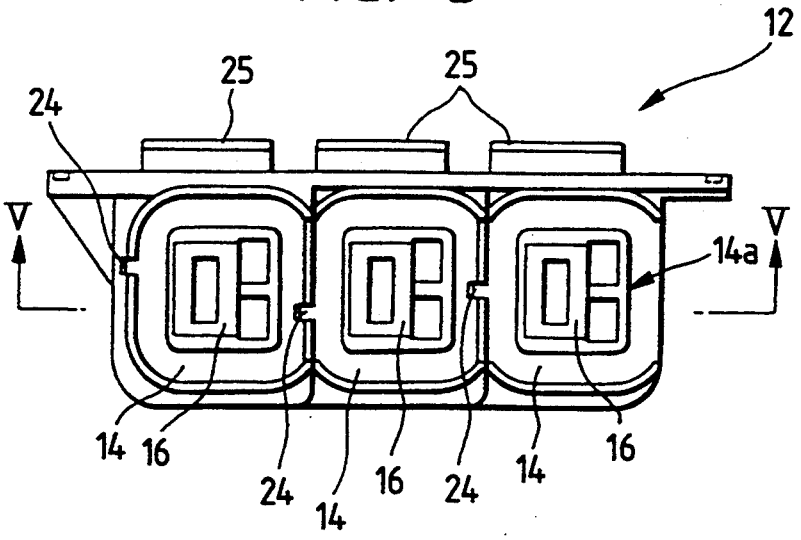
FIG. 3 is a plan view of a connector portion on the upstream apparatus side.
Figure 4:
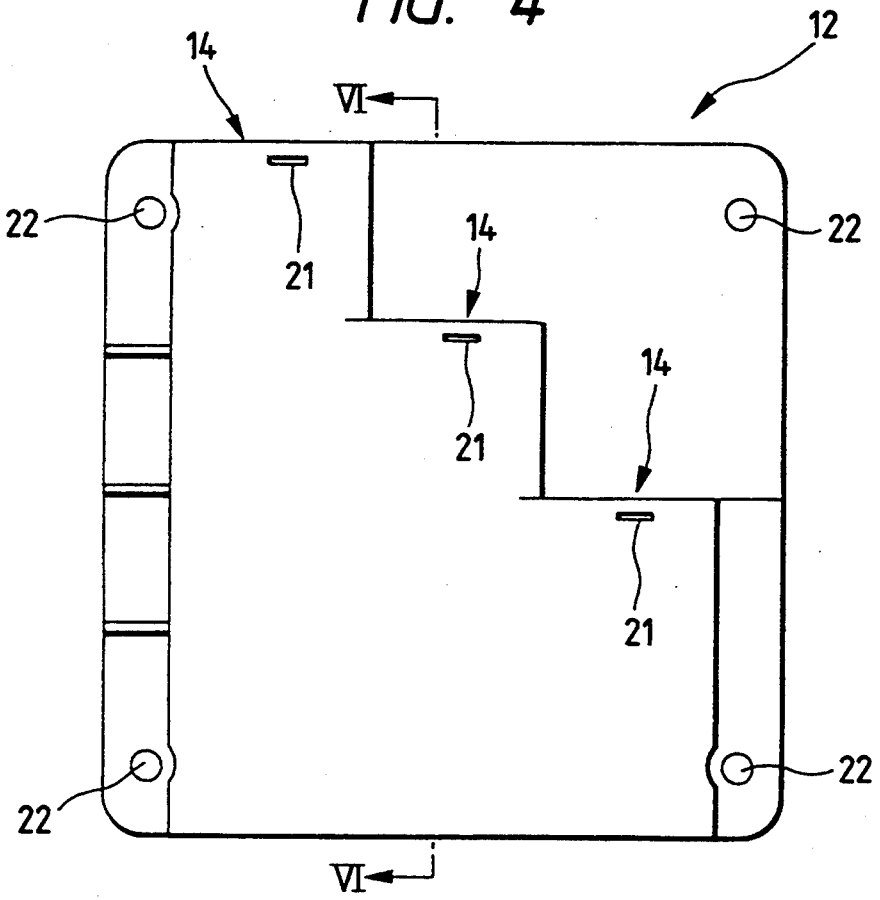
FIG. 4 is a front view of the connector portion on the upstream apparatus side.
Figure 5:
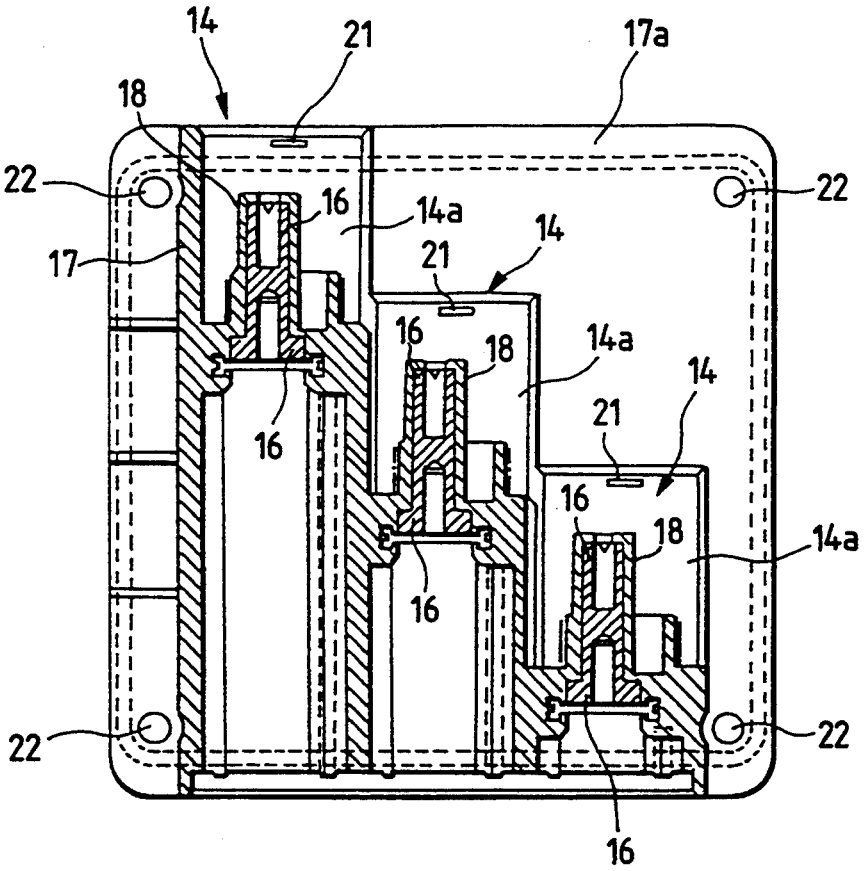
FIG. 5 is a sectional view of the connector portion on the upstream apparatus side taken along line V—V in FIG. 3.
Figure 6:
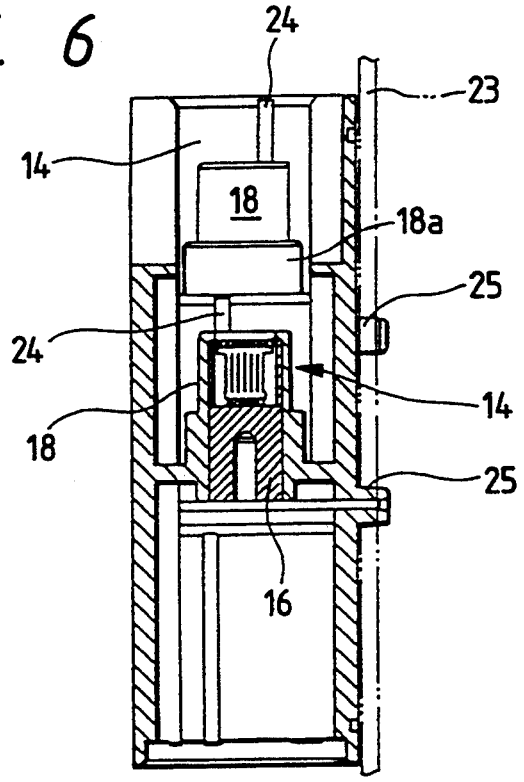
FIG. 6 is a sectional view of the connector portion on the upstream apparatus side taken along line VI—VI in FIG. 4.

Next, the structure of the connector portion 12 will be described in more detail below with reference to FIG. 3 to FIG. 6. FIG. 3 is a plan view of the connector portion 12, FIG. 4 is a side view of the connector portion 12, FIG. 5 is a sectional view of the connector portion 12 taken along line V—V in FIG. 3, and FIG. 6 is a section view of the connector portion 12 taken along line VI—VI in FIG. 4. Since the three connector portion receiving cavities 14 are substantially identical with each other in structure, like parts and components associated with the connector receiving cavities 14 are represented by like reference numerals. As best seen in FIG. 4, the three connector portion receiving cavity 14 are stepwise formed, and the upper surface and one side surface 14a of each connector portion receiving cavity 14 are kept open to the outside. As shown in FIG. 3, a female type terminal 16 having a rectangular cross-sectional contour is disposed at the substantially central part of each connector portion receiving cavity 14. In addition, as shown in FIG. 5, each terminal 16 is covered with a terminal receiving sleeve 18 which is molded integrally with a housing 17.

Specifically, each connector portion receiving cavity 14 is designed such that three surfaces exclusive of the side surface 14a are closed with the housing 17, the upper surface of the same is kept open to the outside, and an upright standing female type terminal 16 is disposed at the substantially central part of the connector portion receiving cavity 14. The terminal 16 is made of an electrically conductive material, and a tab terminal 20 is threadably fastened to the lower part of the terminal 16 by tightening a bolt 19. In contrast with the conventional connector including a male type terminal secured to the attachment surface at a right angle relative to the latter, the terminal 16 is disposed while extending in parallel with the attachment surface of the connector 11.

Engagement grooves 21 are formed on a fixing portion 17*a* of the housing 17 at the positions located in the vicinity of the upper surface of each connector portion receiving cavity 14. As will be described later, the engagement grooves 21 serve to determined whether or not each connector portion 13 is correctly connected to the connector portion 12 by engagement of the engagement grooves 21 with engagement protuberances (to be described later) while projecting from the connector portion 13. In addition, vertically extending guide grooves 24 are formed on the inner wall surface of each connector receiving cavity 14. As will be described later, the guide grooves 24 exhibit a guiding function when each downstream connector portion 13 is electrically connected to the upstream connector portion 12, and moreover, prevent the connector portion 12 from being erroneously connected to the connector portion 13. In this embodiment, the positions where the guide grooves 24 are formed differ from each other with respect to each connector portion receiving cavity 14 in order to prevent erroneous connection of each downstream connector portion 13 to the upstream connector portion 12.

Female threaded holes 22 are formed at four corners of the fixing portion 17*a* of the housing 17 so that a chassis 23 as represented by phantom lines in FIG. 6 is fastened to the fixing portion 17*a* of housing 17 by tightening screws. In addition, three electrically insulative protuberances 25 are formed on the rear surface side of the fixing portion 17*a* of the housing 17. The formation of the electrically insulative protuberances 25 in that way makes it possible to connect tab terminals 20 to opponent circuit terminals or the like in the chassis 23 while the tab terminals 20 are kept electrically insulative relative to the chassis 23.

Figure 7:
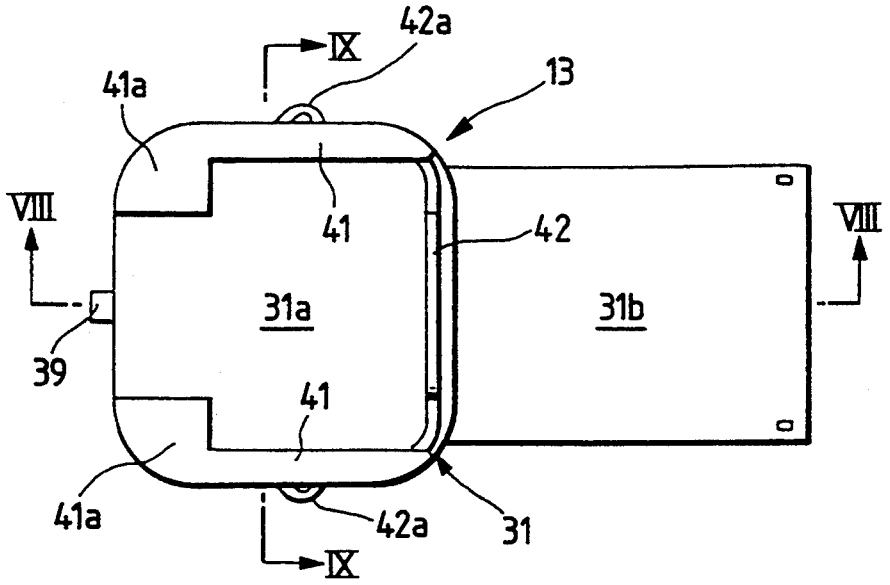
FIG. 7 is a plan view of a connector portion on the downstream apparatus side.
Figure 9:
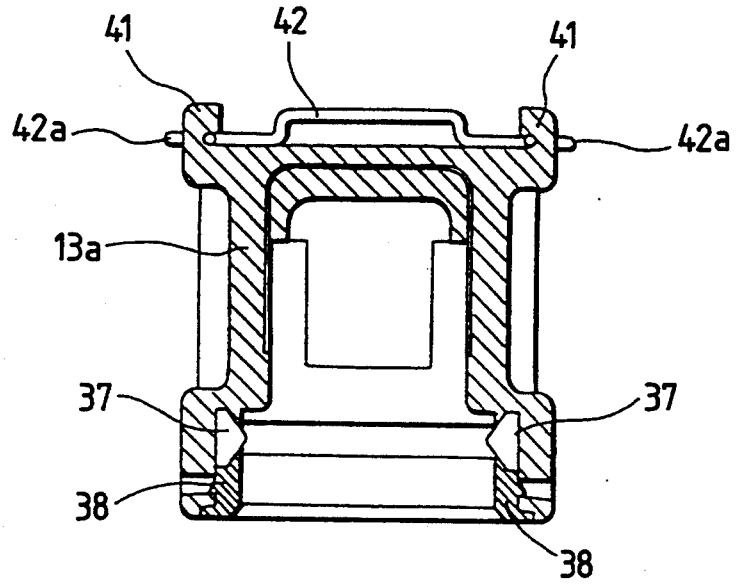
FIG. 9 is a cross-section view of the connector portion on the downstream apparatus side taken along line IX—IX in FIG. 7.
Figure 10:
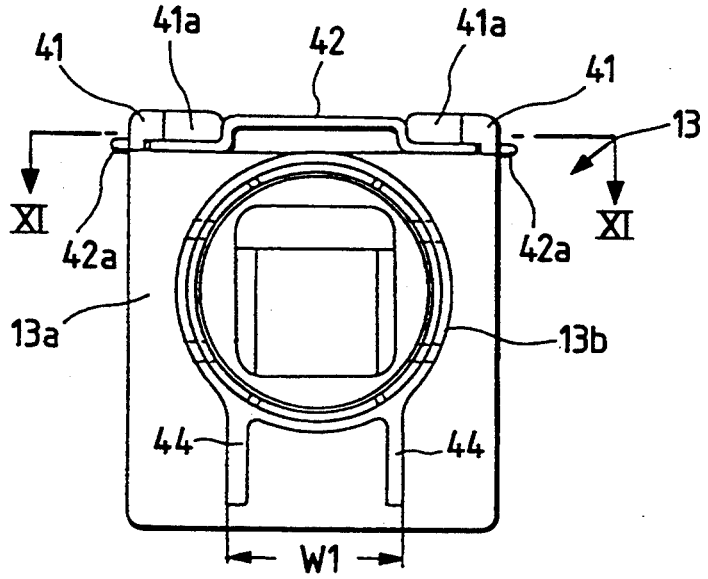
FIG. 10 is a side view of the connector portion on the downstream apparatus side.
Figure 11:
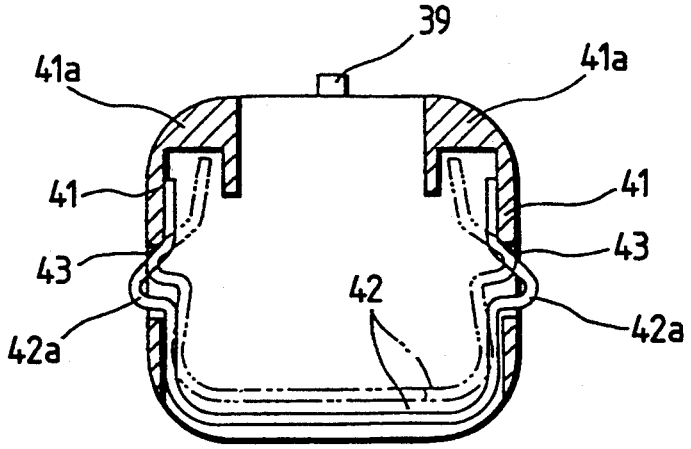
FIG. 11 is a sectional view of the connector portion on the downstream apparatus side taken along line in FIG. 10.

Next, the structure of each downstream connector portion 13 will be described in more detail below with reference to FIGS. 1 and 7–11. FIG. 7 is a plan view of a housing 31 that houses the connector portion 13, FIG. 8 is a sectional view of the housing 31 taken along line VIII—VIII in FIG. 7, FIG. 9 is a cross-sectional view of the housing 31 taken along line IX—IX in FIG. 7, FIG. 10 is a side view of the housing 31, and FIG. 11 is a cross-sectional view of the housing 31 taken along line XI—XI in FIG. 10.

Figure 8:
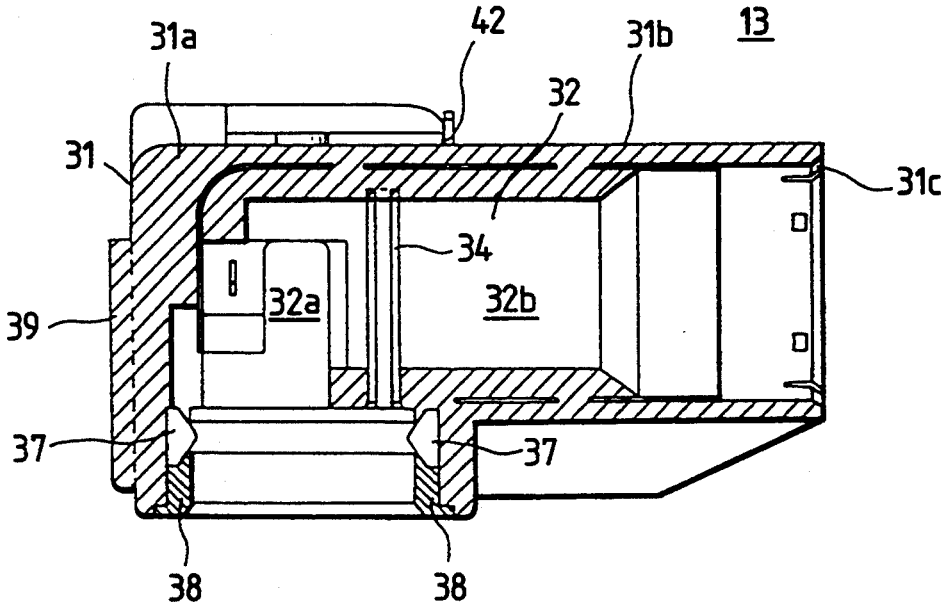
FIG. 8 is a section view of the connector portion on the downstream apparatus side taken along line VIII—VIII in FIG. 7.

Specifically, the downstream connector portion 13 includes a housing 31 integrally molded of a synthetic resin, a male type terminal 33 (se FIG. 1) molded in a key-shaped contour as shown in FIG. 8 and embedded in a hollow portion 32 of the housing 31, and a cable 15 connected to the terminal 33 by crimping or the like. As shown in FIG. 7, the housing 31 includes a fitting portion 31*a* having a substantially square contour and a cylindrical cable connecting portion 31b having a diameter appreciably smaller than a width of the fitting portion 31*a*, and the hollow portion 32 serves to make communication between the fitting portion 31*a* and the cable connecting portion 31*b*. As shown in FIG. 1, a substantially inverted U-shaped foremost end part 33*a* of the terminal 33 is located in a hollow portion 32*a* of the fitting portion 31*a*, and a cylindrical rear end part 33*b* of the terminal 33 is received in the hollow portion 32*b*.

While a sheath layer is peeled off from each cable 15, a core 15*a* of the cable 15 is inserted into a cylindrical rear end part 32*b* of the hollow portion 32*a* so as to allow the cable 15 to be electrically connected to the terminal 33 by crimping or the like. A flange 31*c* is formed on the rear end side of the hollow portion 32 for the purpose of preventing a waterproofing packing 36 from being disconnected from the cable connecting portion 31*b* of the connector portion 13.

Two annular recesses 34 formed at the substantially central part of the hollow portion 32, and engagement rings 35 fitted around the terminal 33 are received in the annular recesses 34 for preventing the terminal 33 from being disengaged from the hollow portion 32. Specifically, an annular recessed portion 33*c* is formed at the substantially central part of the terminal 33 and the engagement rings 35 are fitted around the annular recessed portion 33*c* for preventing the terminal 33 from being disengaged from the hollow portion 32.

A packing 37 is attached to the inner peripheral surface of the hollow portion 32*a* at the lower open end part of the latter with the aid of a packing holder 38. When the connector portion 13 is electrically connected to the connector portion 12, the packing 37 comes in close contact with a stepped part 18*a* formed at the lower end part of a connector portion receiving cavity 14 for the purpose of waterproofing. Thus, waterproofing is achieved for each cable 15 by using the packing 36, and moreover, waterproofing is achieved for each connector portion receiving cavity 14 by using the packing 37, especially in the region where after each connector portion 13 is fitted into the corresponding connector portion receiving cavity 14, the lower end of the connector portion 13 comes in contact with the stepped part 18*a*.

As shown in FIG. 7, FIG. 8, and FIG. 11, a vertically extending elongated guide protuberance 39 is formed on the side surface of the fitting portion 31*a* at the foremost end of the latter. The guide protuberance 39 is fitted into a guide groove 24 formed on the inner wall surface of each connector portion receiving cavity 14. In the case that the position where the guide groove 24 is formed does not coincide with the position where the guide protuberance 39 is formed, each connector portion 13 cannot properly be received in the corresponding connector portion receiving cavity 14, i.e., each cable 15 cannot be connected electrically to the corresponding female type terminal 16.

Two longitudinally extending flanges 41 arranged in the symmetrical relationship relative to extension of the connector portion 13 are formed on the upper surface of the fitting portion 13*a*, and a rod-shaped spring 42 press-bent to exhibit a substantially U-shaped contour is loosely fitted to the lower ends of the flanges 41 in such a manner that it is flexibly deformed to expand and contract.

As is best seen in FIG. 11, cutout portions 43 are formed through both the flanges 41, and triangular protuberances 42*a* made integral with the spring 42 are normally projected outside of the cutout portions 43 by normally projected outside of the cutout portions 43 by the resilient force of the spring 42. The protuberances 42*a* are brought in engagement with the engagement grooves 21 formed on the connector portion 12 side in order to assure that each connector portion 13 is properly received in the corresponding connector portion receiving cavity 14 without any disconnection of the connector portion 13 from the connector 11. Prior to fitting of each connector portion 13 into the connector portion receiving cavity 14, the protuberances 42*a* are inwardly squeezed with operator's fingers as represented by phantom lines (see FIG. 11). Once the connector portion 13 is fitted into the connector portion receiving cavity 14 at a predetermined position, the protuberances 42*a* are received in the engagement grooves 21 by the resilient force of the spring 42. This makes it possible to confirm that the connector portion 13 is reliably received in the connector portion receiving cavity 14 without any possibility that it will be accidently disconnected from the connector 11.

As shown in FIG. 10, a pair of engagement portions 44 are disposed below the cable connecting portion 13*b* while extending in parallel with each other. In the case that a plurality of connector portions 13 are stepwise connected to the connector portion 12 as shown in FIG. 1 and FIG. 2, the engagement portions 44 collide against the upper surface of the connector portion 13 at the lower stage, and a width $W_1$ of the engagement portions 44 as measured between the outer surfaces of the latter is dimensioned to be coincident with a width between foremost end parts 41*a* of the flanges 41.

Next, a process of connecting each connector portion 13 to the connector portion 12 will be described below.

First, a first connector portion 13 is fitted into a connector portion receiving cavity 14 at the lowest stage. Next, a second connector portion 13 is fitted to a connector portion receiving cavity 14 at the intermediate state. Finally, a third connector portion 13 is fitted into a connector portion receiving cavity 14 at the uppermost stage. An operation for fitting each connector portion 13 into the corresponding connector portion receiving cavity 14 is achieved by squeezing it in the downward direction while the guide protuberance 39 is correctly aligned with the guide groove 24.

When the first connector portion 13 is snugly received in the connector portion receiving cavity 14 at the lowest stage, the foremost end part of the substantially inverted U-shaped end portion 33*a* of a male terminal 33 is inserted into the female terminal 16 as shown in FIG. 1, whereby the female terminal 16 can electrically be connected to the male terminal 33. At this time, the protuberances 42*a* are received in the engagement grooves 21 to reach predetermined positions.

Next, the second connector portion 13 is received in a connector portion receiving cavity 14 at the intermediate stage in the same manner as the first connector portion 13. When the second connector portion 13 is fitted into the connector portion receiving cavity 14 at the intermediate stage, the engagement portions 44 are received in the space defined between both the foremost end parts 41*a* of the flange 41 on the connector portion 13 at the lower stage. At this time, if the connector portion 13 at the lower stage is incompletely fitted into the corresponding connector portion receiving cavity 14, causing it to be raised up from the predetermined position, an operator feels that it is difficult to squeeze the connector portion 13 at the intermediate state further in the downward direction. Now, he can know how the connector portion 13 at the lower state has been fitted into the corresponding connector portion receiving cavity 14 at present. To cope with the foregoing incompletely fitted state, the connector portion 13 at the intermediate stage is forcibly squeezed in the downward direction with an operator's hand; thereby, complete fitting of the connector portion 13 at the lower stage and the connector portion 13 at the intermediate stage into the corresponding connector portion receiving cavities 14 can be achieved without fail.

Once the connector portion 13 at the lower stage and the connector portion 13 at the intermediate stage are completely fitted into the corresponding connector portion receiving cavities 14, the protuberances 42 are received in the engagement grooves 21 while they are projected outside of the cutout portions 43. This makes it possible for the operator to confirm that the connector portions 13 are correctly received in the corresponding portion receiving cavities 14.

Next, the third connector portion 13 is fitted into the connector portion receiving cavity 14 at the uppermost stage. Also in this case, the operator can determine in the same manner as mentioned above whether or not the first and second connector portions 13 are correctly fitted into the corresponding connector portion receiving cavities 14. Therefore, when the third connector portion 13 is correctly fitted into the connector portion receiving cavity 14, this means that it is confirmed that the first and second connector portions 13 have been correctly fitted into their corresponding connector portion receiving cavities 14.

Operations for fitting the first to third connector portions 13 into the connector portion receiving cavities 14 at the lowest to uppermost stages are achieved by forcibly squeezing each connector portion 13 from above with an operator's hand. Consequently, each fitting operation, i.e., each connecting operation can simply be achieved with a reduced space required therefor with the result that an apparatus associated with the connector 11 can be constructed with small dimensions at an improved practical installation density.

As shown in FIG. 3, the positions where the guide grooves 24 are formed differ from each other with respect to the connector portion receiving cavities 14. On the other hand, only one kind of guide protuberance 39 is shown in FIG. 7 and FIG. 8. In practice, however, each guide protuberance 39 is formed corresponding to the guide groove 24 as shown in FIG. 3.

Figure 12:
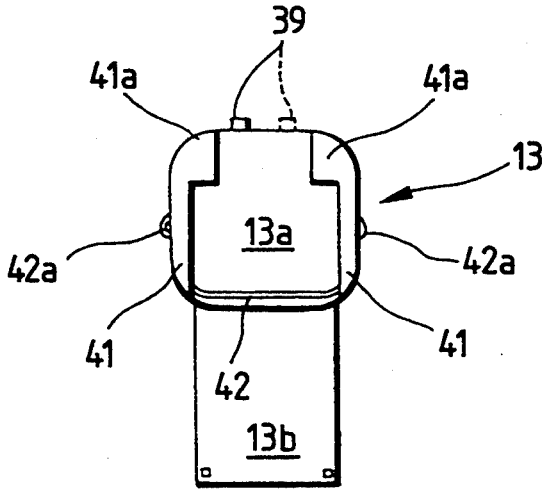
FIG. 12 is a plan view of a connector portion on the downstream apparatus side constructed according to another embodiment of the present invention.
Figure 13:
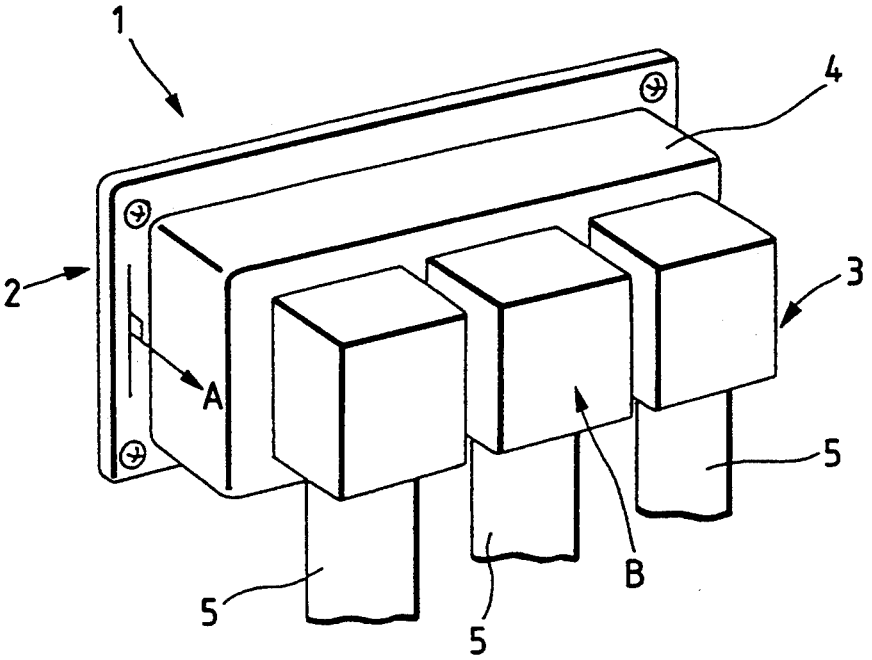
FIG. 13 PRIOR ART
FIG. 13 is a perspective view of a conventional connector.
Figure 14:
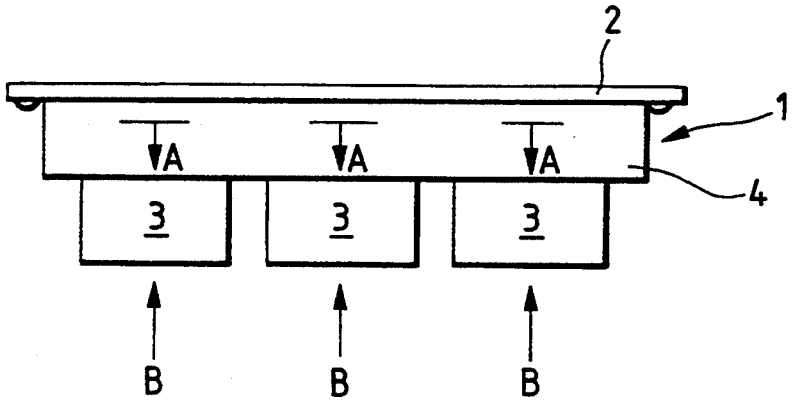
FIG. 14 PRIOR ART
FIG. 14 is a plan view of the conventional connector shown in FIG. 13.

Next, FIG. 12 shows by way of plan view the structure of a connector portion 13 constructed according to another embodiment of the present invention. As shown in the drawing, two vertically extending elongated guide protuberances 39 are formed on the front side surface of the connector portion 13 in order to assure that each connector portion 13 is more reliably and correctly fitted into the corresponding connector portion receiving cavity 14 in cooperation with guide grooves 24.

As shown in FIG. 1, according to the present invention, the first connector portion 13 corresponds to the connector portion receiving cavity 14 at the lower stage, the second connector portion 13 corresponds to the connector portion receiving cavity 14 at the intermediate stage, and the third connector portion 13 corresponds to the connector portion receiving cavity 14 at the upper stage as represented by phantom lines.

With the connector 11 constructed in the abovedescribed manner, there does not arise a malfunction that each connector portion 13 is erroneously electrically connected to the connector portion 12.

The present invention has been described above with respect to the case that electricity is fed from the upstream apparatus side to the downstream apparatus side. However, the present invention should not be limited only to this case but it may equally be applied to the case that electricity is fed from the downstream apparatus side to the upstream apparatus side. In addition, the number of female terminals 16 and the number of male terminals 33 should not be limited only to three. Additionally, the connector portion receiving cavities 14 and the female terminals 16 may be arranged with a slantwise upward attitude depending on a manner of mounting the connector 11 on a certain apparatus.

What is claimed is:

1. A connector, comprising:

a connector portion on an upstream apparatus side fixedly secured to a predetermined apparatus;

a plurality of connector portions on a downstream apparatus side electrically connectable to said connector portion on the upstream apparatus side;

a plurality of terminals connectable to opponent cables stepwise arranged on said connector portion on the upstream apparatus side and located in parallel with a stationary plane of said connector portion on the upstream apparatus side;

a plurality of connector portion receiving cavities stepwise arranged around each of said terminals; and detecting means for detecting whether said connector portions on the downstream apparatus side are correctly respectively fitted into said connector portion receiving cavities, wherein said connector portions on the downstream apparatus side are successively fittable into said connector portion receiving cavities in the direction at a right angle relative to extension of said terminals, starting from said connector portion receiving cavity at a lowest stage, and wherein said detecting means detects whether said connector portions on the downstream apparatus side are correctly fitted into said connector portion receiving cavities at lower stages based on whether said connector on the downstream apparatus side at an upper stage is correctly fitted into its corresponding said connector portion receiving cavity.

2. A connector as claimed in claim 1, wherein said detecting means comprises:

a pair of resilient protuberances, resiliently projecting from opposite side surfaces of a housing of each of said connector portions on the downstream apparatus side and receivable in said housing; and a pair of engagement grooves, formed on opposite side walls of each connector portion receiving cavity corresponding to positions where said resilient protuberances project when said connector portion on the downstream apparatus side is correctly fitted into respective said connector portion receiving cavity, wherein said resilient protuberances are received by respective said engagement grooves when said connector portion on the downstream apparatus side is correctly fitted into respective said connector portion receives cavity.

* * * * *